United States Patent [19]

Foster

[11] 4,006,617

[45] Feb. 8, 1977

[54] METHOD AND APPARATUS FOR ROLL FORMING TAPERED STRUCTURAL MEMBERS

[75] Inventor: Gene B. Foster, Seattle, Wash.

[73] Assignee: The Boeing Company, Seattle, Wash.

[22] Filed: Nov. 24, 1975

[21] Appl. No.: 634,431

[52] U.S. Cl. ..... 72/7; 72/8; 72/21; 72/181; 72/240

[51] Int. Cl.[2] ..... B21D 5/08

[58] Field of Search ..... 72/7, 21, 8, 181, 179, 72/176, 247, 240, 365, 366, 187

[56] References Cited

UNITED STATES PATENTS

| | | | |
|---|---|---|---|
| 1,078,240 | 11/1913 | Barbour | 72/247 |
| 3,081,653 | 3/1963 | Kincaid | 72/8 |
| 3,566,638 | 3/1971 | Herbst | 72/8 |
| 3,903,723 | 9/1975 | Colbath | 72/181 X |

*Primary Examiner*—Milton S. Mehr
*Attorney, Agent, or Firm*—Christensen, O'Connor, Garrison & Havelka

[57] ABSTRACT

A plurality of forming stations, each individually numerically controlled to sequentially roll form a blank into a tapered structural member, is disclosed. Each forming station includes upper and lower assemblies of forming rolls mounted on a pair of adjacent shafts so as to generally define an orifice through which the blank passes as it is roll formed. One of the shafts is continuously position adjustable, as are selected forming rolls of the forming roll assemblies. Thus, both the size and shape of the orifice are continuously adjustable. Position sensors continuously sense the positions of the position controllable shaft and forming rolls of each station and generate feedback signals related thereto. The feedback signals are continuously compared with numerical control signals received by a controller. The results of the comparisons produce error signals that are used to continuously control the position of the position controllable shafts and forming rolls.

42 Claims, 20 Drawing Figures

Fig. 1.
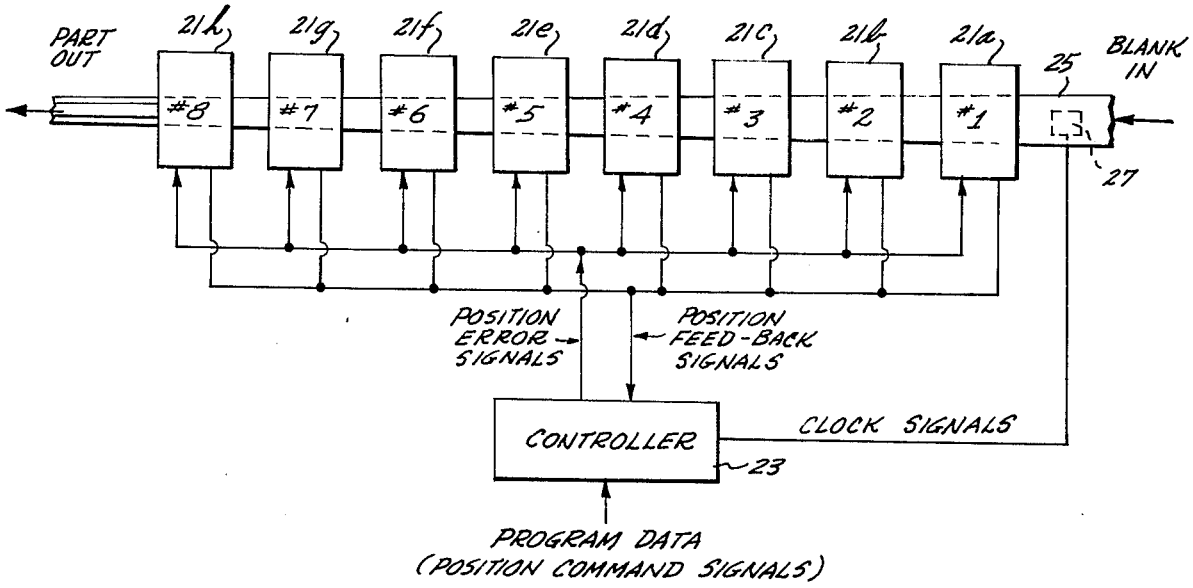
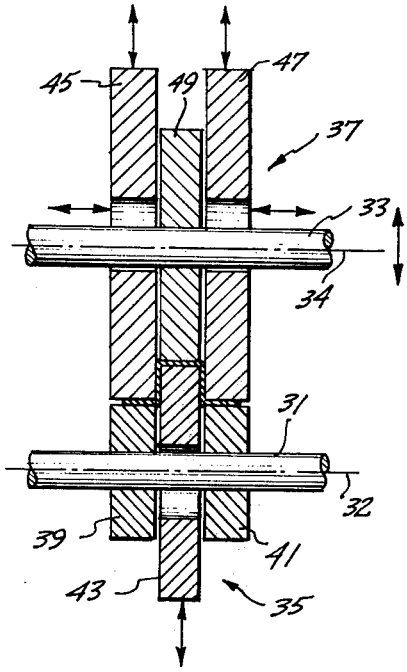
Fig. 2B.
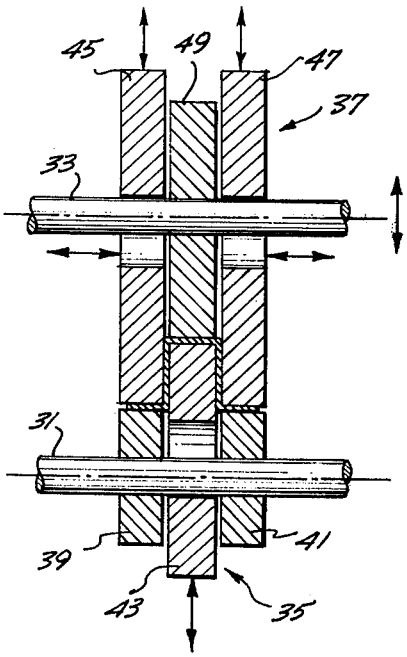
Fig. 2A.

METHOD AND APPARATUS FOR ROLL FORMING TAPERED STRUCTURAL MEMBERS

BACKGROUND OF THE INVENTION

This invention is directed to roll forming and more particularly, roll forming structural members.

Various products are formed by creating a skeleton formed of structural members and covering the skeleton with a "skin". For example, most modern aircraft, particularly those of a relatively large size, are formed by creating skeletons of structural members and covering the skeletons with sheets of aluminum alloy. The structural members are usually formed of an aluminum alloy or some other roll formable material. Many of the structures used to form such aircraft vary in cross-sectional size from one end to the other (e.g., a wing or a fuselage). Because of such cross-sectional variations and because the load carrying capability of such structures varies from region-to-region, obviously, the strength of the structural members can also vary. Further obviously, the structural efficiency of aircraft, particularly advanced aircraft, will be improved if the structural members used (e.g. ribs and stringers) can be made to vary in both thickness and cross section (height and/or width) without an undue increase in manufacturing costs, because such variations will allow a designer to vary the section modulus (e.g. strength) along the length of a structural member to suit loading conditions. The end result of this variation is to substantially reduce the weight and/or surface area of the resultant airframe, which reductions translate into improved range, speed and pay load.

Currently, aircraft structural members formed of aluminum alloy taper in thicknesses only, and not in height and width, except as noted below. Such members are formed in complex, variable orifice draw dies or in progressive rolls wherein the final roll stages are mechanically or hydraulically actuated so as to taper the thickness of the member being formed. It will be appreciated that structural members produced in this manner are severally limited as to the degree of variation in section modulus that can be produced. If it is desired to create an overall structural member that varies in cross section (as well as thickness), in the past, such members have been produced by first forming relatively short sections each having a fixed, but different cross-sectional height and/or width. The sections may or may not vary in thickness, as desired. These sections are spliced together using mechanical fasteners or bonded doublers to achieve the desired overall taper. Obviously, splicing is time consuming and expensive. Moreover, vibration and other movement of the resultant structure may result in a fatigue critical joint requiring substantial reinforcement. Hence, assembling tapered structural members in this manner has a variety of disadvantages.

The only presently available method of producing continuous, long variable cross-section structural members is to machine them from extrusions. According to this method, a blank that is large enough to encompass the total range of section taper is first extruded. The blank is then machined to the desired shape. It will be appreciated that this method is both costly and tedious. It is costly, first, because of the production time required and, second, because a large portion of the extrusion is lost in chips, which may or may not be recoverable. Even if recoverable, the chips must be reprocessed before they are usable. Since substantial amounts of energy are required to produce most metals, in particular aluminum, considerable energy waste is incurred in chip loss and the reprocessing of chips to a usable form.

Therefore, it is an object of this invention to provide a new and improved method of and apparatus for roll forming continuous tapered structural members.

It is a further object of this invention to provide a new and improved method of and apparatus for roll forming relatively long, continuous, tapered structural members suitable for use in forming the skeleton of an aircraft.

It is another object of this invention to provide a method of and an apparatus for roll forming tapered structural members that does not require that the members be machined to any significant degree after they have been formed.

It is yet another object of this invention to provide a method of and an apparatus for continuously forming structural shapes that vary both in thickness and taper (height and/or width).

SUMMARY OF THE INVENTION

In accordance with principles of this invention, a plurality of forming stations, each individually numerically or mechanically controlled so as to sequential roll form a blank into a tapered structural member, are provided. Each forming station includes a plurality of forming rolls, some of which are fixed and others of which are horizontally and/or vertically position controllable. The forming rolls of each station are mounted on adjacent shafts so as to generally define an orifice through which the blank passes as it is roll formed. One or both of the shafts may be position adjustable.

In accordance with other principles of this invention, a controller, adapted to read a numerical program, continuously controls the position of the position controllable forming rolls and shafts of the plurality of stations.

In accordance with further principles of this invention, position sensors sense the position of the position controllable forming rolls and shafts and generate feedback signals that are received by the controller. The feedback signals are continuously compared with related control signals and the results of the comparisons form error signals. The error signals are utilized to continuously control the position of the position controllable forming rolls and shafts.

In accordance with still further principles of this invention, hydraulic mechanisms are utilized to control the positions of the position controllable forming rolls and shafts. Further, a rate sensor senses the rate of movement of the blank through the apparatus of the invention and generates clock signals that are utilized by the controller to control the rate of comparison and, thus, the rate of change of the position of the various position controllable forming rolls and shafts of the various stations.

It will be appreciated from the foregoing description that the invention provides a method of and an apparatus for roll forming tapered structural members. Numerical control information, which may be stored on magnetic tape, punch tape, cards, etc., programs a controller by applying position command signals thereto. The controller also receives clock signals, which control its rate of application of position error signals to a plurality of forming stations, each such station being adapted to roll form a blank in a controlled manner. Position feedback signals, generated by each station, are compared in the controller with the position command signals and the results of the comparisons form the position error signals. The position error signals continuously control hydraulic actuators mounted so as to control the position of the plurality of position adjustable rolls and shafts located at each station.

It will also be appreciated that the foregoing description describes the preferred embodiment of the invention. However, as will be obvious to those skilled in the art, other means of roll position control, such as endless cams used in conjunction with tracer valves can be used, if desired, particularly for simple tapered structural members.

Preferably, the lateral edges of the blank are pretrimmed prior to the blank entering the apparatus of the invention. More specifically, prior to entry into the apparatus of the invention, the lateral edges of the blank can be precut to a particular design, consistent with the changing cross section, by laser cutters or numerically controlled edge mills, for examples. Thus, the blank profile is prefixed such that the desired variable taper cross-sectional configuration is readily formed as the blank passes through the apparatus of the invention. Conversely, the structural member can be roll formed by the apparatus of the invention such that excess material is positioned at the edges of the member. The excess material may then be removed by continuous circular shears located downstream of the final forming station.

It will further be appreciated that the invention overcomes the disadvantages of prior art methods of achieving generally the same end result, i.e., a tapered structural member. More specifically, tapered structural members formed in accordance with the invention are continuous, i.e., they are not formed of individual sections spliced together. In addition, no machining of a relatively large thick structural shape is required. Hence, labor and material costs are reduced and energy requirements are minimized.

It is pointed out here that, while the present invention was developed for use in forming aircraft structural members and is described in such an environment, other uses for tapered structural members exist. Thus, persons skilled in the art will recognize that the invention is suitable for use in other environments also. For example, the invention can be used to form metal building rafters, the structural members for mass transit cars and recreation vehicles, etc. In general, the invention is useful in any environment requiring the mass production of tapered metal structural members.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is a block diagram of a numerically controlled apparatus for roll forming tapered structural members formed in accordance with the invention;

FIG. 2A is a cross-sectional schematic diagram of the forming rolls and shafts of the final station of a simple hat section roll forming machine formed in accordance with the invention in a first position;

FIG. 2B is a cross-sectional schematic diagram of the forming rolls and shafts of the final station of simple hat section roll forming machine formed in accordance with the invention in a second position;

DESCRIPTION OF THE PREFERRED EMBODIMENT

Figure 3A:
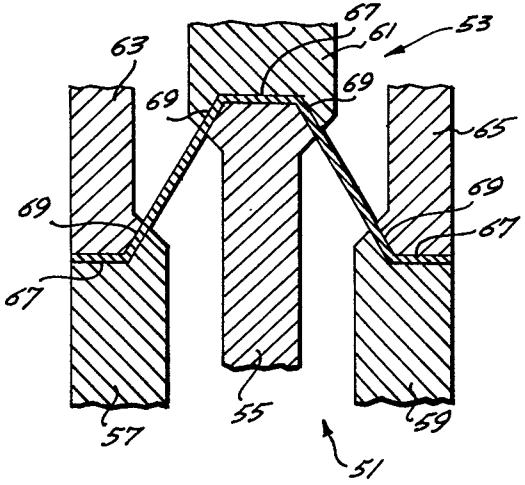
FIG. 3A is a partial cross-sectional schematic diagram of the forming rolls of an intermediate station of a simple hat section roll forming machine formed in accordance with the invention in a first position.

FIG. 1 is a block diagram illustrating a numerically controlled apparatus for roll forming tapered structural members formed in accordance with the invention and comprises: eight roll forming stations 21*a*–21*h;* and, a controller 23. Each roll forming station includes assemblies of forming rolls, one or more of which includes horizontally and/or vertically position controllable forming rolls. The assemblies are mounted on adjacent parallel shafts, one or both of which are also position controllable. The eight roll forming stations are sequentially identified by the numbers 1 through 8 and arrayed such that a blank 25 to be roll formed passes sequentially through each station in their numerical order, from right to left as illustrated by the arrows in FIG. 1. It should be noted that eight stations are used merely as an example. A greater or lesser number can be used, as dictated by the tapered nature of the member to be roll formed and the material being formed. Preferably, the lateral edges of the blank are pretrimmed prior to entry into the first station, as more fully hereinafter described.

A rate sensor 27 is mounted so as to sense the rate of movement of the blank 25 through the plurality of stations 21*a*–21*h* and generate a chain of pulses having a frequency related to this rate. Thus, the rate sensor may be a shaft encoder mounted on a roll shaft, or coupled directly to the blank via a soft or serrated wheel. In any event, the pulses generated by the rate sensor 27, identified as clock signals in FIG. 1, are applied to the controller 23.

In accordance with the nature of the part to be roll formed, the controller 23 also receives position command signals from an external source, designated program data in FIG. 1. The program data may be stored on a magnetic tape, punched cards, or a punched tape, for example, or manually inserted. The program data may be inserted into a memory forming part of the controller, in its entirety or may be intermittently "read" by the controller, as needed. In addition, if desired, the controller may include a temporary storage for storing a portion of the program, with the storage being updated at selected intervals, as needed. In any event, the program data instructs the controller as to the various positions that the moveable elements of the eight stations should take as the blank is moved through the stations.

In addition to the program data, the controller also receives position feedback signals from each of the eight stations. A position feedback signal is generated for each controllable position of each controllable element of each station. The controller produces position error signals formed in the manner hereinafter described. A position error signal is generated for each controllable position of each controllable element of each station. The appropriate position error signals are applied to each of the eight stations.

Preferably, the controller is separately hardwired to each station both for reception of position feedback signals and for transmission of position error signals. However, if desired, these signals can be multiplexed and applied on one, two or more common buses connecting the controller to the eight roll forming stations.

Figure 12A:
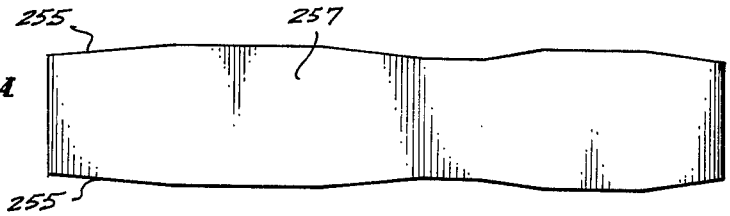
FIG. 12A is a plan view of a blank prior to its being roll formed.
Figure 12B:
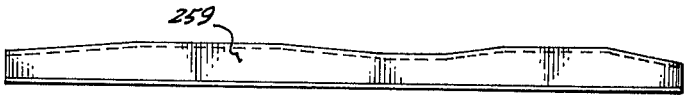
FIG. 12B is an elevational view of the blank illustrated in FIG. 12A after it has been roll formed into a continuous, simple hat section.

In operation, as the blank 25 is fed through the eight roll forming stations, program data (position command signals) for each controllable element of each station is compared with the position feedback signal or signals related to that element. The results of the comparisons form the position error signals. The position error signals control the position of the controllable elements of each station such that each element is moved toward, and maintained at, the position dictated by the program data. Thus, the position of each controllable element is continuously being controlled and may be continuously position adjusted as the blank passes through the various stations. Hence, the exiting structural member may be continuously tapered from a relatively thick end to a relatively thin end, if desired. Alternatively, intermediate regions of a continuous member may have different tapers and configurations than other regions, as illustrated in FIG. 12B and hereinafter described. In addition to varying the taper of the member, the thickness of the member can also be varied.

FIGS. 2A and 2B are cross-sectional schematic diagrams illustrating a typical arrangement of the rollers and shafts located at the last of the eight stations 21*a*–21*h*. More specifically, each station includes first and second parallel shafts 31 and 33. Preferably, the shafts are mounted for rotation about vertically spaced, horizontal axes; thus, one of the shafts, illustrated as the first shaft 31, forms a lower shaft and the other shaft, illustrated as the second shaft 33, forms an upper shaft. The axis 32 of the lower shaft 31 is illustrated as fixed and defines a line of reference. The axis 34 of the upper shaft 33 is illustrated as vertically movable toward and away from the axis 32 of the lower shaft 31.

A first or lower assembly of forming rolls 35 is mounted on the lower shaft 31 and a second or upper assembly of forming rolls 37 is mounted on the upper shaft 33. The assemblies of forming rolls are generally aligned with one another and each assembly comprises three rolls—a pair of outer forming rolls and an inner forming roll—mounted in side-by-side relationship. In the case of the lower assembly of forming rolls 35, the outer forming rolls 39 and 41 are transversely affixed to the lower shaft and the inner forming roll 43 is transversely movable. In the case of the upper assembly of forming rolls the outer forming rolls 45 and 47 are transversely movable with respect to the upper shaft and the inner forming roll 49 is transversely fixed. In addition, the outer forming rolls of both the upper assembly of forming rolls are axially movable with respect to their shaft. The arrows illustrated in FIGS. 2A and 2B illustrate the potential directions of movement of the varous forming rolls of the upper and lower assemblies of rollers plus the direction of movement of the upper shaft. As depicted in FIGS. 2A and 2B, the movement of the forming rolls and the upper shaft allow the dimensions of the orifice formed between the upper assembly of forming rolls 37 and the lower assembly of forming rolls 35 to be controlled. FIG. 2A illustrates a relatively large orifice (both with respect to the size of the simple hat section being formed and with respect to the thickness of the walls of the simple hat section), whereas FIG. 2B illustrates a relatively small orifice (in both respects). In accordance with the method of operation of the invention, the relatively large orifice changes to the relatively small orifice (or vice versa) as the size and/or thickness dimensions of the resultant part changes. Thus, if the resultant structural member is to taper from one end to the other end, in a continuous linear manner, the orifice illustrated in FIG. 2A may denote the cross-sectional configuration at one end and the orifice illustrated in FIG. 2B the cross-sectional configuration at the other end. Or, they may illustrate intermediate cross-sectional configurations.

Figure 3B:
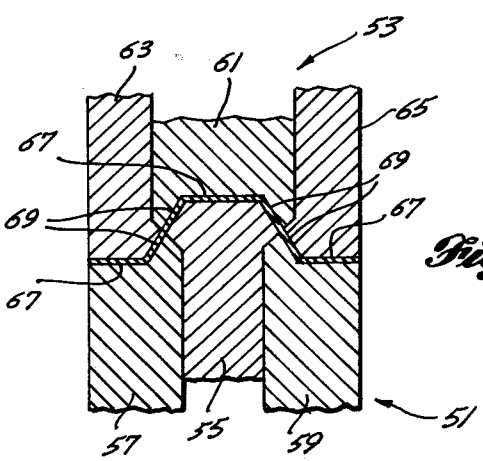
FIG. 3B is a partial cross-sectional schematic diagram of the forming rolls of an intermediate station of a simple hat section roll forming machine formed in accordance with the invention in a second position.

FIGS. 3A and 3B illustrate different positions of the adjacent portions of the upper and lower assemblies of forming rolls of an intermediate station, for example, station six of the sequence of stations illustrated in FIG. 1. More specifically, FIGS. 3A and 3B illustrate a lower assembly of forming rolls 51 and an upper assembly of forming rolls 53. The lower assembly 51 comprises a transversely movable inner forming roll 55 and a pair of transversely fixed outer forming rolls 57 and 59. The upper assembly 53 comprises a transversely fixed inner forming roll 61, and a pair of transversely movable outer forming rolls 63 and 65. As will be seen by comparing FIGS. 3A and 3B, the outer forming rolls 57 and 59 of the lower assembly of forming rolls 51 are axially movable, as well as the outer forming rolls 63 and 65 of the upper assembly.

Rather than the peripheries of the associated forming rolls of the upper and lower assemblies 53 and 51 being spaced from one another an entirely shaft axis parallel path, as are the associated forming rolls illustrated in FIGS. 2A and 2B, the associated rolls illustrated in FIGS. 3A and 3B include shaft axis parallel aligned regions 67 and shaft axis transverse aligned regions 69.

Thus, the orifice located between the forming roll assemblies, rather than defining a right rectangular hat-shape, define a trapezoidal hat-shape. As will be better understood from the following discussion of FIGS. 4 and 5, this trapezoidal configuration is formed at the intermediate stations of a roll forming mechanism formed in accordance with the invention for forming tapered simple hat structural members.

As with the assemblies of forming rolls 35 and 37 illustrated in FIGS. 2A and 2B, the dimensions of the orifice formed between the assemblies 51 and 53 illustrated in FIGS. 3A and 3B change as the part is formed. FIG. 3A illustrates a discontinuous orifice wherein the operative periphery of the transversely movable inner forming roll 55 of the lower assembly 51 is substantially farther away from the axis of the lower shaft than it is in FIG. 3B. In addition, in FIG. 3A all outer forming rolls are horizontally separated from the inner forming rolls by a relatively large distance, whereas they are horizontally closely spaced in FIG. 3B. Thus, the discontinuous orifice illustrated in FIG. 3A is substantially larger than the continuous orifice illustrated in FIG. 3B. Moreover, the separation between related rolls of the upper and lower assemblies is substantially greater in FIG. 3A than in FIG. 3B, whereby the wall thickness of the part being formed is greater in FIG. 3A than in FIG. 3B. As with the forming roll assemblies illustrated in FIGS. 2A and 2B, in operation, the assemblies illustrated in FIGS. 3A and 3B may start at the configuration illustrated in FIG. 3A and move to the configuration illustrated in FIG. 3B (or vice versa) as the taper and thickness of the resultant structural member changes from one end to the other.

Figure 4:
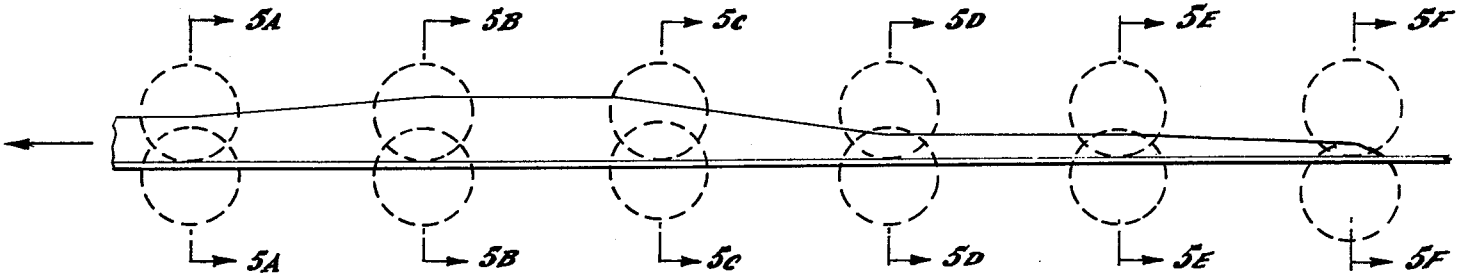
FIG. 4 is a schematic diagram illustrating the rolling action performed at a plurality of stations of a roll forming machine formed in accordance with the invention during the forming of a simple hat section.

FIG. 4 is a schematic elevational view illustrating, in phantom, upper and lower forming rolls at a plurality of stations. Illustrated in solid line is a generalized silhouette of the structural member being formed, as it moves through the stations. It will be appreciated from viewing FIG. 4 that each assembly of forming rolls may be in an entirely different position as the member is being formed. In addition to being in different positions at any one time, the assemblies (and upper shaft) are individually controlled such that the dimensions between upper and lower assemblies is changed under the control of the controller 23. The change may be continuous or discontinuous depending upon the nature of the part being formed. The change is continuous if a constant taper is being formed and discontinuous if the part includes a zero taper region or regions, as well as a taper region or regions. In all cases changes relate to a fixed point of reference illustrated as the base line formed by the axis of the lower shaft 31 in the described embodiment of the invention.

Figure 5F:
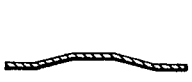
FIGS. 5A–F are cross-sectional diagrams of a simple hat section taken at various related stations illustrated in FIG. 4.
Figure 5E:
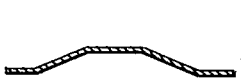
Figure 5D:
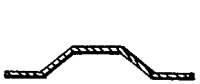
Figure 5C:
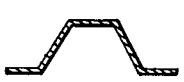
Figure 5B:
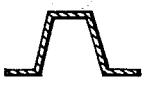
Figure 5A:
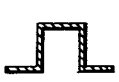

FIGS. 5A–F illustrate the cross-sectional configurations of a structural member passing through the stations illustrated in phantom in FIG. 4. FIG. 5A illustrates the final configuration i.e., a right rectangular simple hat. FIGS. 5B–5F illustrate earlier configurations from an almost right angled, trapezoidal configuration (FIG. 5B) to an almost flat trapezoidal configuration (FIG. 5F).

Figure 6:
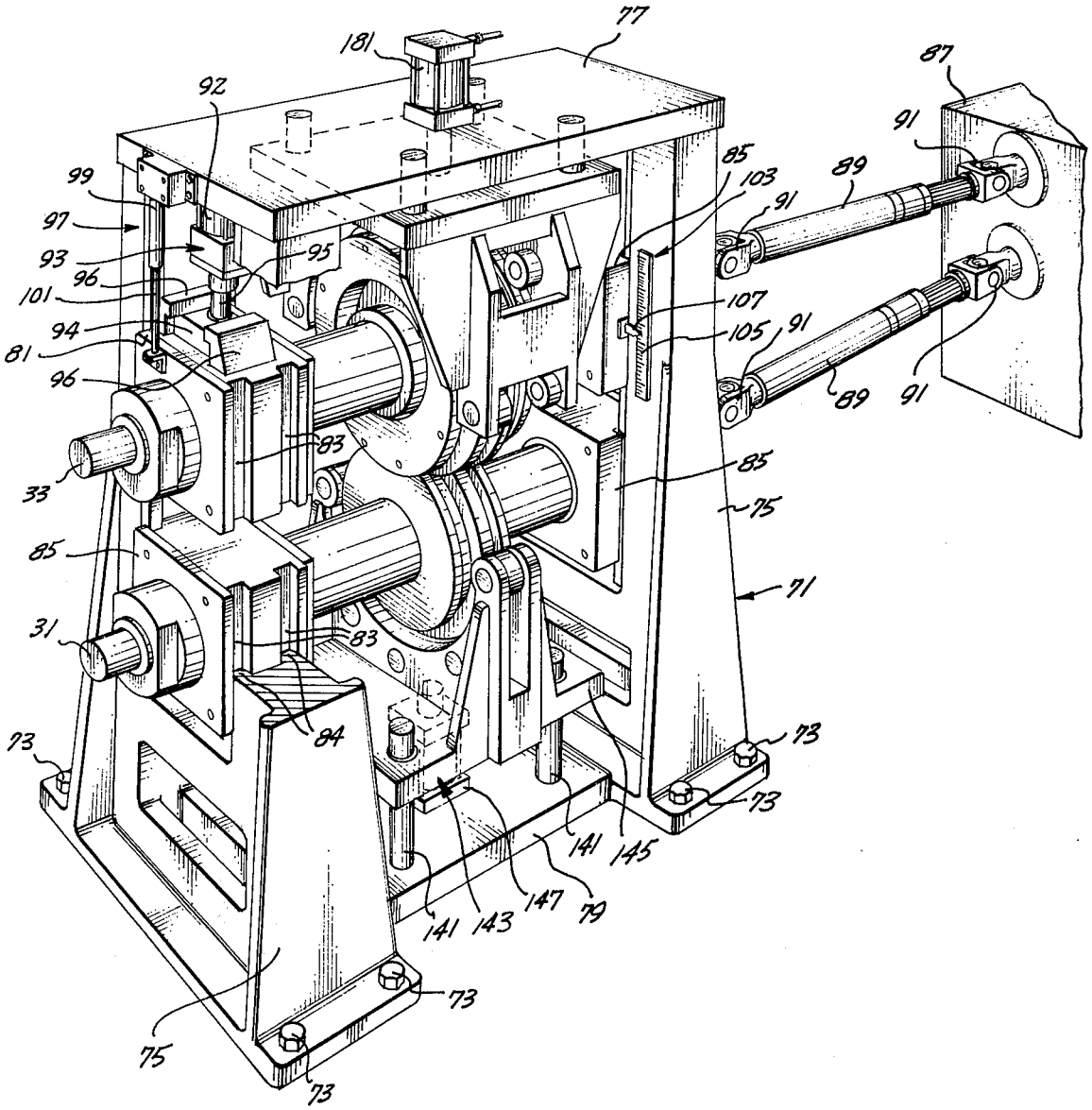
FIG. 6 is a perspective view of the mechanism located at one of the plurality of stations illustrated in FIG. 1.
Figure 11:
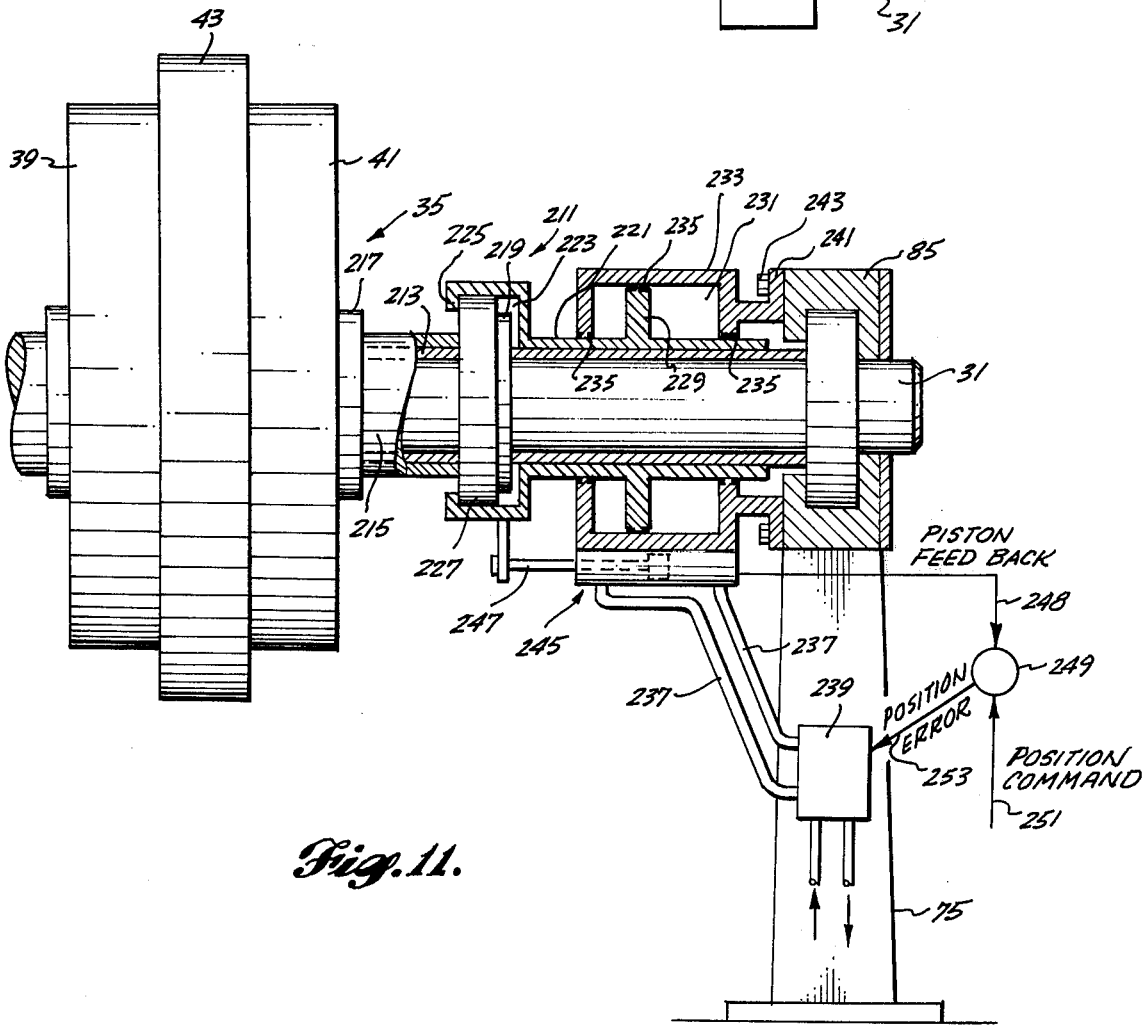
FIG. 11 is a cross-sectional diagram, partially in section, illustrating a mechanism for controlling the position of a forming roll along a horizontal axis.

FIG. 6 is a perspective view, partially in section, of a roll forming station formed in accordance with the invention. For reasons of clarity, the hydraulic mechanism for transversely moving the outer forming rolls is not illustrated in FIG. 6. Rather, a mechanism suitable for performing this function is illustrated in FIG. 11 and hereinafter described. The roll forming station illustrated in FIG. 6 comprises a frame 71 including two spaced parallel sides or legs 75, an upper support plate 77 and a base support plate 79. The upper support plate extends across the top end of the legs 75 and the base support plate extends between the bottom end of the legs. Base bolts 73 located at the bottom of the legs affix the frame to a machine base.

Slidably mounted for vertical movement in each leg are upper and lower shaft bearing blocks 81 and 85. The lower shaft bearing blocks 85 rotatably support the lower shaft 31 and the upper shaft bearing blocks 81 rotatably support the upper shaft 33. Normally, the lower shaft bearing blocks are movable only so that their position can be preadjusted by any suitable mechanical or hydraulic position control mechanism (not shown). Thereafter they remain fixed so that the axis of the lower shaft 31 will define a reference line, as previously described. It will be appreciated that, in some situations it may be necessary or desirable to reverse this arrangement and make the lower shaft position controllable, with the upper shaft serving as the reference.

Both the lower and upper shafts 31 and 33 are connected to a rotary power source 87 via connecting rods 89 and associated universal joints 91, one located at either end of each connecting rod. While this drive arrangement is preferred to accommodate the desired vertical shaft movement, other suitable drive arrangements can be used, if desired.

Vertical alignment of the shaft bearing blocks 81 and 85 is maintained by a pair of vertical slots 83 formed in the two opposing sides of each block that interface with the leg 75. These slots 83 form keyways that coact with elongated keys 84 formed in adjacent portions of the legs 75.

The positions of the upper bearing blocks 81 are controlled by shaft position hydraulic actuators 93, only one of which can be viewed in FIG. 6. The housings 92 of the shaft position hydraulic actuators are attached to the bottom surface of the upper support plate 77 and include downwardly extending vertically movable shafts 95. The outer ends of these shafts are attached to blocks 94 mounted in hook-shaped arms 96 attached to the upper ends of the respective upper shaft bearing blocks 81. The hydraulic actuators are conventional in that, in accordance with the receipt of hydraulic pressure on either side of a cylinder, their shafts 95 move inwardly or outwardly with respect to their housing 92. This movement, due to the mechanical coupling, causes the upper shaft bearing blocks 81 to move upwardly or downwardly, as the case may be.

The position of the upper blocks 85 are sensed by shaft position sensors 97. The shaft position sensors, for example, may be linear variable differential transformers (LVTDs) and, thus, comprise a housing 99 affixed to the upper plate 77 and an outwardly extending movable rod 101. Since sensors of this nature, and others suitable for use by the invention, are well known in the position sensing art, their operation will not be described in detail here. In addition, if desired, an upper shaft position indicator 103 comprising a scale 105 affixed to an adjacent portion of a leg 75 and a pointed 107 affixed to an associated upper block 81 may be included if it is desired that the operator have a visual indication of the position of the upper shaft.

Figure 7:
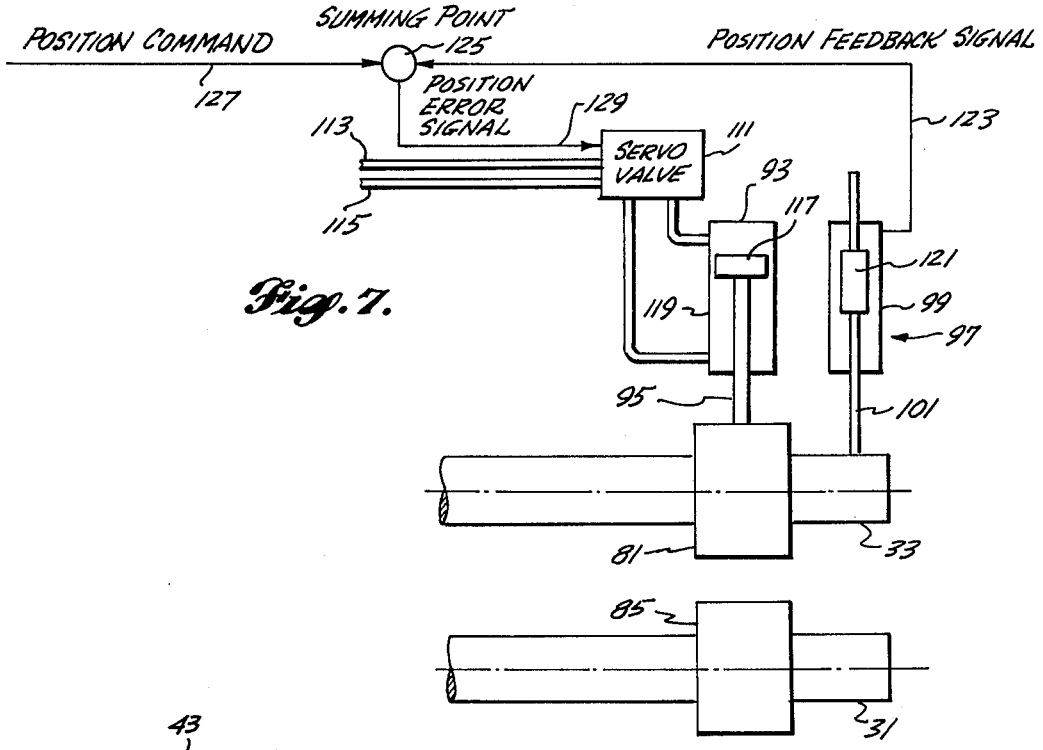
FIG. 7 is a schematic diagram illustrating a control system for controlling the vertical position of the movable shaft of a roll forming station.

FIG. 7 illustrates schematically the manner in which the position of the upper shaft 33 is controlled, only the control mechanism controlling one upper shaft bearing block 81 being illustrated. The vertically movable shafts 95 of the hydraulic actuators 93 control the position of the upper shaft 33 by moving their related shaft bearing blocks 81 up and down, as required. More specifically, a shaft position servo valve 111 affixed to input and output hydraulic lines 113 and 115 controls the application of hydraulic pressure to either side of a piston 117 mounted in a cylinder 119 forming a part of the housing 92 of each shaft position hydraulic actuator 93. The pistons 117 are connected to the shafts 95 of the hydraulic actuators 93. In a conventional manner, the servo valve meters hydraulic fluid on either side of the piston thereby raising and lowering the piston 117, as required, to position the upper shaft 33.

The rod 101 of the LVDT 97 controls the position of a slug 121 housed inside the housing 99 of the LVDT. The position of the slug controls the magnitude of a position feedback signal applied via a conductor 123 to a summing junction 125, which forms part of the controller 23 (FIG. 1). Position command signals for the upper shaft (which are derived from program data) are applied via a position command conductor 127 to the summing junction 125. The output of the summing junction 125 is a position error signal that is applied via a position error conductor 129 to the control input of the servo valve. Thus, the position error signal controls the operation of the servo valve 111 which control, in turn, controls the flow of hydraulic fluid to the hydraulic actuator 93 and, thus, the position of the upper shaft 33.

In the foregoing manner, the position of the upper shaft 33 is controlled with respect to the lower shaft 31, whereby the position of the upper assembly of forming rolls with respect to the lower assembly of forming rolls is controllable.

As previously described, the transverse position of the inner roll 43 (FIG. 2A and 2B) of the lower assembly of forming rolls 35 with respect to the lower shaft 31 is controllable. In addition, the transverse position of the outer rolls 45 and 47 of the upper assembly of forming rolls 37 with respect to the upper shaft 33 are controllable. The mechanism for controlling the position of these forming rolls will now be described.

Figure 8:
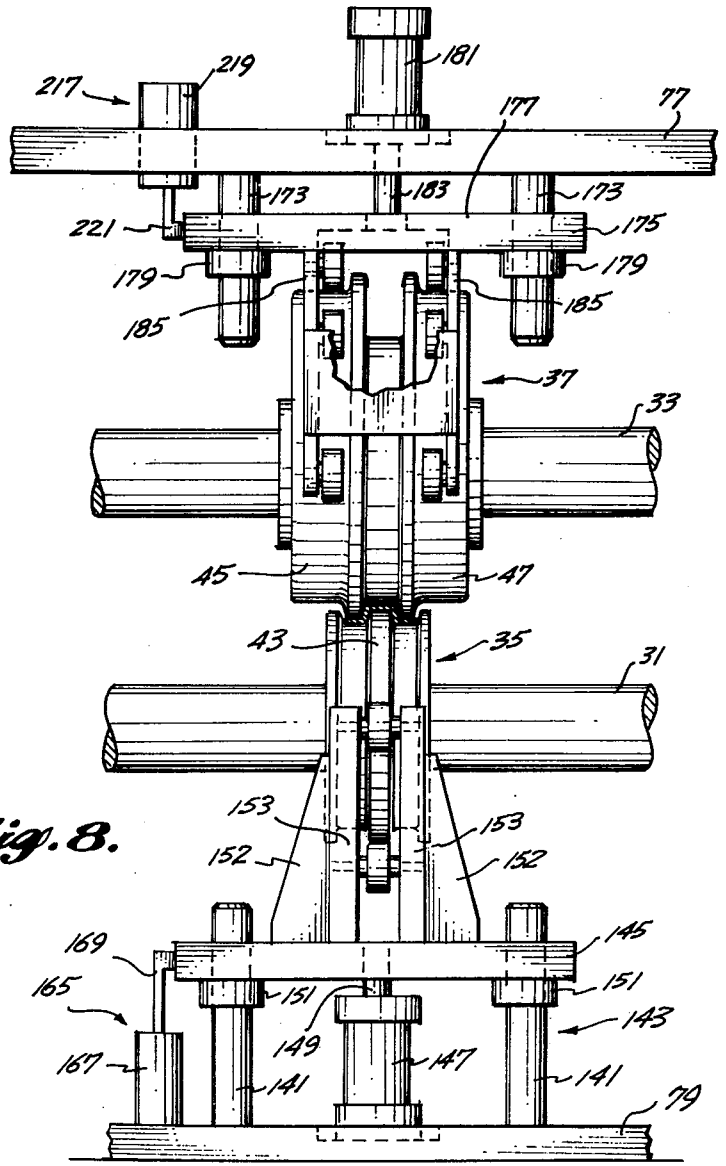
FIG. 8 is a diagram illustrating a mechanism for vertically positioning selected upper and lower forming rolls at a roll forming station.

Turning first to the apparatus for controlling the position of the inner roll 43 (or 55) of the lower assembly of forming rolls 35 (or 51); as best illustrated in FIGS. 6 and 8, extending vertically upwardly from the base support plate 79 are four rectangularly spaced lower guide rods 141. The lower guide rods 141 are generally located outside of the lower assembly of rolls, when viewed from above. Mounted on the lower guide rods 141 is a movable lower table 143. The lower table 143 includes a horizontal plate 145 having apertures through which the lower guide rods 141 pass. In order to insure alignment of the lower table 143 on the lower guide rods 141, bosses 151 are located beneath each aperture in the horizontal plate 145. It will be evident to those skilled in the art that this arrangement forms a die set, commonly used to position actuated, matched forming dies.

Also affixed to the base support 79 is a lower forming roll position hydraulic actuator 147. This hydraulic actuator, as best seen in FIG. 8, includes a vertical shaft 149 whose outer end is affixed to the lower surface of the horizontal plate 145 of the lower table 143. In operation, actuation of the lower forming roll position hydraulic actuator 147 causes its shaft 149 to move upwardly and downwardly, as desired. Movement of the shaft 149 moves the lower table 143 upwardly and downwardly.

Two roller support plates 153 extend vertically upwardly from the horizontal plate 145. The roller support plates 153 lie orthogonal to the axis of the lower shaft 31—one on either side of the inner forming roll 43 of the lower assembly of forming rolls 35. Angle support ribs 152 extend between the outer faces of the roller support plates 153 and the upper surface of the horizontal plate 145.

Each roller support plate 153 includes a U-shaped aperture 154 large enough to prevent the roller support plates from impinging on the outer forming rolls 39 and 41 of the lower assembly of forming rolls 35. Extending between the roller support plates 153 about the U-shaped apertures 154 are a plurality of roller shafts 155. Mounted on the roller shafts 155, between the roller support plates 153, are a plurality of rollers 157. The roller shafts 155 and rollers 157 are positioned such that a portion of the peripheral surfaces of the rollers project beyond the edge of the U-shaped apertures 154.

Figure 10:
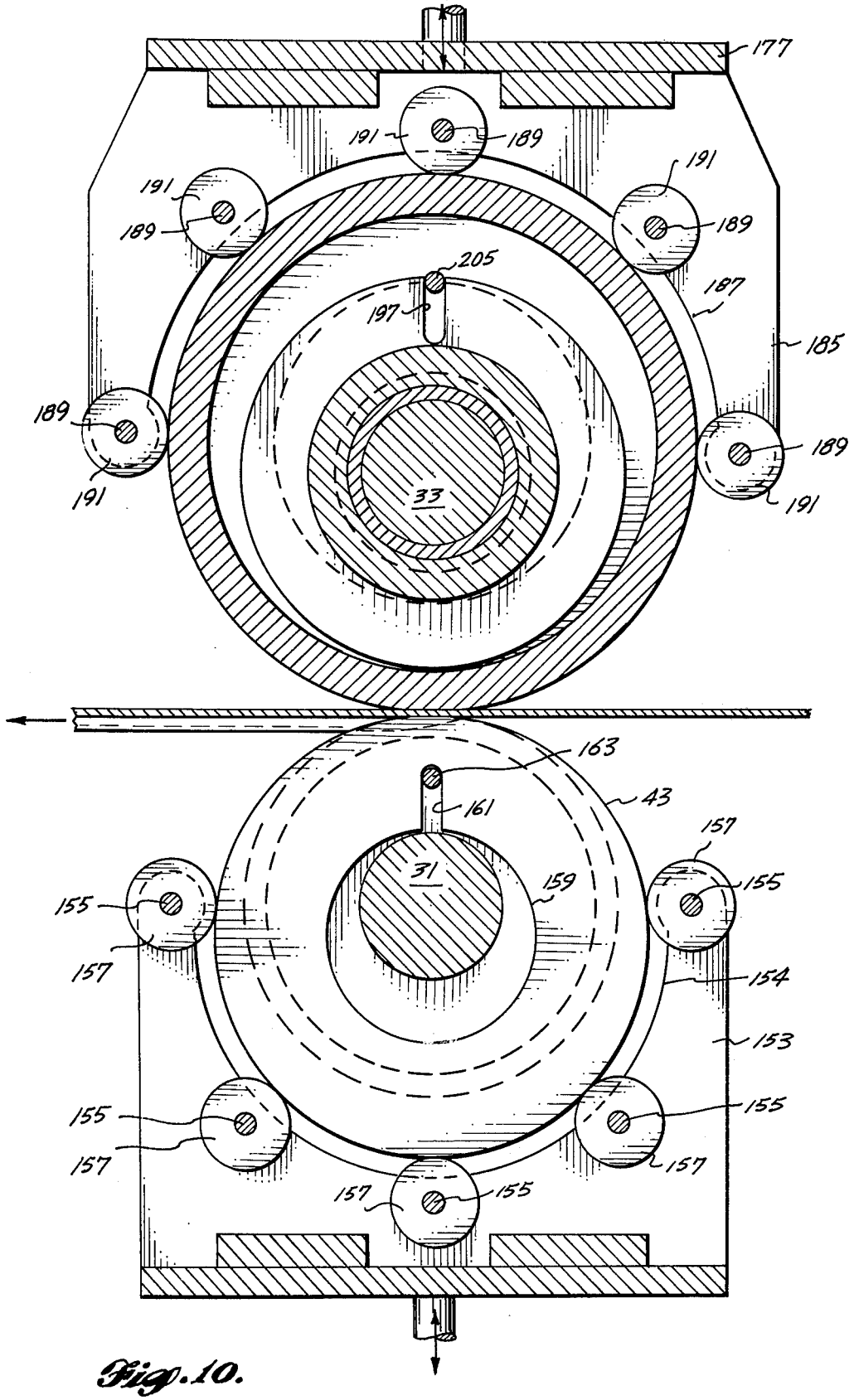
FIG. 10 is a cross-sectional diagram along line 10—10 of FIG. 9.

The rollers 157 ride on the outer surface of the inner roll 43 of the lower assembly of forming rolls 35 so as to capture and control the transverse position of the inner roll 43. More specifically, as illustrated in FIG. 10, the inner forming roll 43 includes a large, centrally located cylindrical aperture 159. The diameter of this aperture 159 is substantially larger than the diameter of the lower shaft 31. Thus, the inner forming roll 43 is movable transversely with respect to the lower shaft 31. Transverse movement is controlled by the pressure applied to the rollers 157 by the lower table 143. The pressure applied by the lower table, in turn, is controlled by the pressure it receives from the lower forming roll position hydraulic actuator 147, applied in the manner previously described. Transverse movement of the inner forming roll is provided without interference with the rotational movement of the inner forming roll due to the inclusion of the rollers 57.

Figure 9:
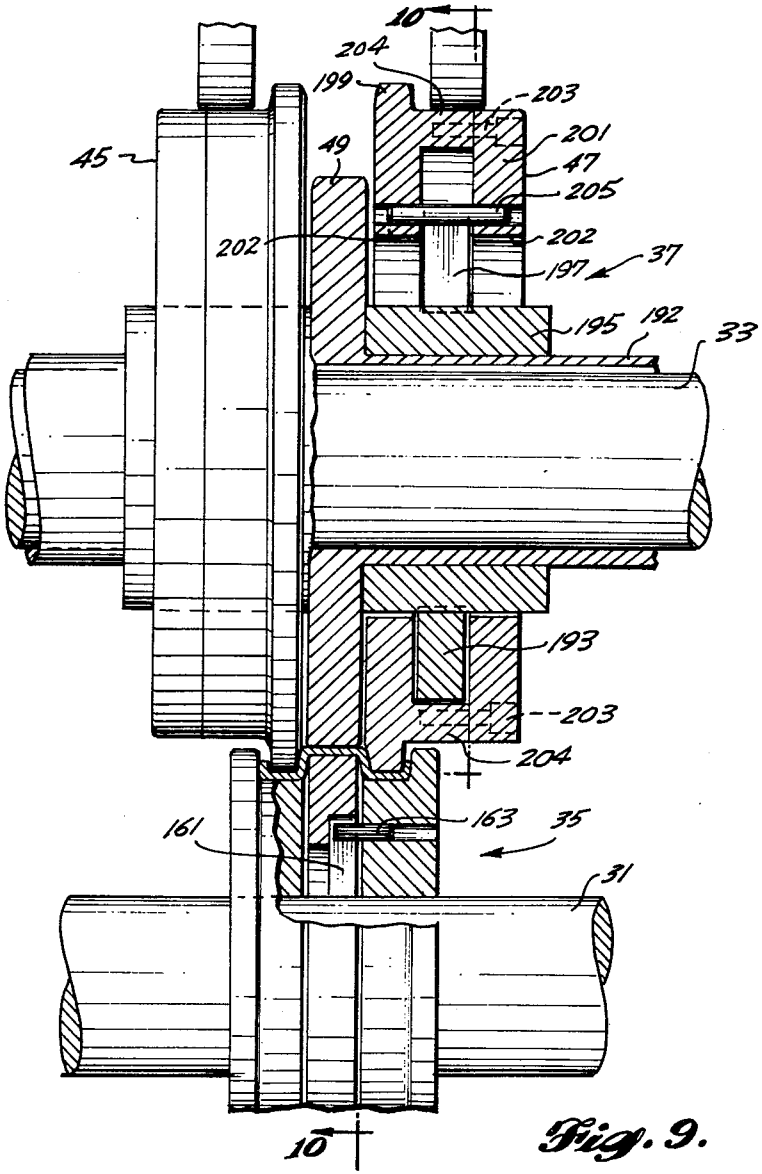
FIG. 9 is a cross-sectional diagram, partially in section, illustrating the driving interconnection between driven forming rolls affixed to a shaft and forming rolls that are vertically movable.

Even though the inner forming roll is transversely movable, it still receives driving power via a slot/pin mechanism. More specifically, the inner forming roll 43 of the lower assembly of forming rolls 35 includes, as best illustrated in FIGS. 9 and 10, a radial slot 161. A pin 163 affixed to one of the outer forming rolls rides in the slot 161. Thus, as the outer forming roll, which is affixed to the shaft 31, is rotated, the pin impinges on one side of the slot 161 and applies driving power to the inner forming roll 43. It will be appreciated that this slot/pin mechanism allows the inner forming roll to move vertically in the manner previously described.

The position of the movable inner roll 43 of the lower assembly of forming rolls 35 may be controlled by sensing the position of the horizontal plate 145 forming part of the lower table 143. The position of the horizontal plate is sensed by a suitable position sensor, such as an LVDT 165 having its housing 167 affixed to the base support plate 79 and its movable rod 169 affixed to the horizontal plate 145. The position information creates a feedback signal that, when summed with a position command signal, creates a position error signal which, via a servo valve, controls the lower forming roll position hydraulic actuator 147. While the inner forming roll 43 of the lower assembly may be controlled by this mechanism, normally it is not position controlled. Rather, it is left free (under a preset actuator pressure) to follow the lower surface of the blank, which, in turn, is positioned by the position of the inner forming roll 49 of the upper assembly 37.

A mechanism generally similar to the mechanism for controlling the position of the inner forming roll 43 of the lower assembly of forming roll 35 may be used to control the position of the outer forming rolls 45 and 47 of the upper assembly of forming rolls 37. In this regard, as with the inner forming roll 43 of the lower assembly, usually the outer forming rolls 45 and 47 of the upper assembly are allowed to float under a preset actuator pressure and follow the upper surface of the blank, which, in turn, is positioned by the outer forming rolls 39 and 41 of the lower assembly. In any event, a mechanism for controlling the position of the outer forming rolls 45 and 47 of the upper assembly is best illustrated in FIGS. 6, 8, 9 and 10 and is next described. The mechanism for controlling the position of the outer forming rolls of the upper assembly of forming rolls includes an upper table 175 mounted on four downwardly extending upper guide rods 173. The upper guide rods are affixed to the upper support plate 77 and positioned about the outer edges of the upper assembly of forming rolls 37, when viewed from above.

The upper table 175 includes a horizontal plate 177 having apertures through which the upper guide rods 173 project. Bosses 179, affixed to the lower surface of the plate 175, surround the rods 173 and assist in maintaining the horizontal alignment of the plate 175. Affixed to the upper surface of the upper plate 77 of the frame 71 is an upper forming roll position hydraulic actuator 181. The shaft 183 of the upper forming roll position hydraulic actuator 181 passes through the upper plate 77 and extends from the actuator's housing to the upper surface of the horizontal plate 177 of the upper table 175. Thus, the upper forming roll position hydraulic actuator 181 causes the horizontal plate 177 to be moved vertically upwardly and downwardly.

Spaced, parallel roller support plates 185 extend downwardly from the horizontal plate 177. The roller support plates 185 are positioned orthogonal to the upper shaft 33, slightly offset from the central planes defined by the outer forming rolls 45 and 47. Each roller support plate 185 includes an inverted U-shaped aperture 187 spaced from its related forming roll, best seen in FIG. 10. Located about the periphery of each U-shaped aperture 187 are a plurality of shafts 189. Aligned shafts are mounted on each support plate 185 and project toward one another. Mounted on the shafts 189 are positioning rollers 191. A portion of the periphery of each positioning roller 191 rides on its related outer forming roll 45 or 47 of the upper assembly of forming rolls 37. It will be appreciated that, with this arrangement, hydraulic forces created by the upper forming roll position hydraulic actuator 181 are transmitted to the outer forming rolls, via the horizontal plate 177, the roller support plates 185 and the positioning rollers 191.

As with the transversely movable inner rolls of the lower assembly of forming rolls 35, the transversely movable outer rolls of the upper assembly of forming rolls 37 are also rotatably driven. A mechanism for rotatably driving the outer forming rolls 45 and 47 is illustrated in FIGS. 9 and 10. As best seen in FIG. 9, the inner forming roll 39 includes axial outwardly projecting sleeves or hubs 192 affixed to the upper shaft 33 by any suitable mechanisms, such as splines, for example. In any event, mounted on and affixed to each sleeve 192 is a disc 193. Each disc includes outwardly projecting hubs 195 and a slot 197 (FIG. 10). The outer forming rolls 45 and 47 are each formed of inner and outer circular sections 199 and 201, one mounted on either side of the associated disc 193. Both inner and outer sections include axial apertures 202 substantially larger in diameter than the diameter of the disc hubs 195, about which they lie. These large axial apertures 202 allow the sections and, thus, the rollers they form to be transversely movable. One of the sections, illustrated as the inner section 199 includes a cylindrical flange 204 that is spaced from, but surrounds, the outer periphery of the disc 193. Cap screws 203 attach the other section 201 to the flange 204.

Extending between the inner and outer sections 199 and 201 so as to lie in the slot 197 is a pin 205. Thus, as the shaft 33 rotates, the disc 193 rotates. Rotation of the disc, via the pin/slot mechanism, causes the inner and outer sections 199 and 201 to rotate. In this manner, power applied to the shaft 33 is transferred to the outer forming rolls 45 and 47. The pin/slot mechanism provides such transfer without restricting the transverse movement of the outer forming rolls.

The position of the outer forming rolls 45 and 47 of the upper assembly of forming rolls 37 is sensed by LVDT 207 having its housing 209 affixed to the upper support plate 77 and its rod 210 attached to the horizontal plate 177 of the upper table 175. Again, summing feedback signals with position command signals creates position error signals adapted to control the upper forming roll position hydraulic acutator 181.

As noted above, a mechanism for axially moving the outer forming rolls of the upper and lower assembly of forming rolls is not, for purposes of clarity, illustrated in FIG. 6. FIG. 11 illustrates one mechanism for providing this function for the lower assembly of forming rolls. A similar mechanism could be used for the upper assembly of forming rolls, except that a slot-pin mechanism would have to be included to allow the outer forming rolls to move transversely, as well as axially.

The axial movement mechanism 211 illustrated in FIG. 11 includes a sleeve 213 affixed on the lower shaft 31. Slidably mounted on the sleeve 213 adjacent the outer forming roll 41 whose position is to be axially controlled is a sliding sleeve 215. The sliding sleeve 215 includes two cylindrical flanges 217 and 219, one located on either end. The flange 217 adjacent to the outer forming roll 41 is affixed thereto.

Also slidably mounted on the sleeve 213 is a hydraulically actuated sleeve 221. The hydraulically actuated sleeve 221 is mounted on the side of the sliding sleeve 215 remote from the side affixed to the outer forming roll 41. The flange 219 of the sliding sleeve 215 remote from the outer forming roll lies inside of a relatively large diameter cylindrical housing 223 forming in the adjacent end of the hydraulically actuated sleeve 221. The sliding sleeve 215 is affixed to the hydraulically actuated sleeve 221 by a locking ring 227 located in the region between the flange 219 and an inwardly projecting flange 225 formed in the end of the cylindrical housing 223.

The hydraulically actuated sleeve 221 includes a coaxially formed, integral disc-shaped projection 229. The disc-shaped projection forms a piston that lies in a hydraulic cylinder 231 defined by a hydraulic piston housing 233. The hydraulic piston housing 233 surrounds the outer end of the hydraulically actuated sleeve 221 and includes a cylindrical aperture through which the sleeve passes. O-rings 235 located about the outer peripheries of the disc-shaped projection 229 and the inward projections of the hydraulic piston housing 233 form seals in these regions. The portions of the hydraulic cylinder 231 lying on either side of the disc-shaped projection 229 are connected via hydraulic lines 237 to a servo valve 239. In addition, the hydraulic piston housing 233 includes mounting flanges 241 that are affixed to the adjacent lower shaft support block 85 by bolts 243.

In operation, the application of hydraulic force to one side or the other side of the disc-shaped projection 229 causes it to move in one direction or the other in the hydraulic cylinder 231. This movement is conveyed via the hydraulically actuated sleeve 221 to the sliding sleeve 215. Movement of the sliding sleeve 215, in turn, causes axial movement of outer forming roll 41 to which it is affixed.

The position of the associated outer forming roll 41 is sensed by an LVDT 245 having its housing 246 affixed to the hydraulic piston housing 233 and its rod 247 affixed to the slidable sleeve 221. The output of the LVDT is connected via a position feedback conductor 248 to a summing junction 249. The summing junction 249 forms part of the controller 23 (FIG. 1) and also receives a position command signal via a position command conductor 251. In accordance with the information it receives, the summing junction applies a position error signal via a position error conductor 253 to the servo valve 239. The servo valve, in turn, adjusts the position of the disc-shaped projection 229 so as to null out the error.

In summary, the invention provides hydraulic mechanisms adapted to transversely move selected forming rolls with respect to shafts with which they are associated. In addition, selected forming rolls are movable axially along their shafts. Further, at least one shaft is movable with respect to the other shaft. The position of the various movable forming rolls, as well as the position of the movable shaft are sensed, preferably utilizing electronic position sensors. The sensed position signals are fed back and compared with position command signals. The results of the comparisons form position error signals that are utilized via servo valves to cause related forming rolls and shafts to move to commanded positions. Position changes may be continuous if a continuous taper change (in size and/or thickness) is desired. The changes may be linear, non-linear or vary between linear and non-linear. Further, the taper can go from a decrease in size to an increase and vice versa.

As noted above, preferably, prior to the entry of a blank into an apparatus formed in accordance with the invention such as the multiple station apparatus illustrated in FIG. 1, the lateral edges of the blank are cut to a predetermined configuration. This configuration is commensurate with the developed blank widths for the changing cross-section and may be continuous from one end to another, or it may be more complex. FIG. 12A illustrates one form of complex blank configuration. In FIG. 12A the lateral edges 255 of the blank 257 first tend to diverge outwardly (moving from left to right). Thereafter, the edges are parallel for a predetermined distance, and, then, they converge inwardly. Next, the edges are again parallel. Then, they diverge outwardly. After again remaining parallel for a predetermined distance, the edges finally converge inwardly. A blank of this nature can be roll formed by the apparatus of the invention into a simple hat structure 259 of the type illustrated in FIG. 12B that first increases in taper form from a relatively small size to a larger size, then remains continuous in size for a predetermined distance. This structure then tapers to a smaller size and, again, remains continuous in size for a distance. The structure then tapers to a larger size, remains continuous and, finally, tapers to a smaller size.

All of these taper changes may be made with or without thickness changes and without any break in the material continuity of the resultant structural member. In this regard, it should be understood that, when a thickness taper is desired, said taper must be formed in the blank by a prior taper machining or rolling operation. In addition to a simple hat configuration, other cross-sectional configurations can also be formed in accordance with the invention. For example, FIGS. 8 and 9 illustrate a return flange hat, rather than a simple hat, being cross-sectionally tapered. Alternatively, channels, zees and other cross-sectional configurations can be tapered in accordance with the invention.

While the preferred embodiment of the invention has been illustrated and described, it will be appreciated by those skilled in the art and others that various changes can be made therein without departing from the spirit and scope of the invention. For example, in addition to different types of cross-sectional configurations, pneumatic movement mechanisms, as opposed to hydraulic movement mechanisms, can be used by the invention. Also, as noted above mechanical positional controls such as endless cams coupled with tracer valves can also be used. Further, positions sensing devices other than LVDTs can be utilized, if desired. Finally, one or more rolling stations can be used to finish form and size taper blanks performed by other methods and apparatus. Hence, the invention can be practiced otherwise than as specifically described herein.

The embodiments of the invention in which the exclusive property or privilege is claimed are defined as follows:

1. A method of roll forming tapered structural members comprising the steps of:

passing a blank through a plurality of roll forming stations, each of said stations including assemblies of forming rolls, at least one of said forming rolls of each assembly being individually and differently position adjustable with respect to the position of the position adjustable forming rolls of the other of said plurality of roll forming stations; and, controlling the position of said position adjustable forming rolls of said plurality of roll forming stations as said blank passes through said plurality of roll forming stations in a manner such that the position of said position adjustable forming rolls of each roll forming station are selectively, independently varied in an individual and different manner between zero variation and continuous variation as a given point of said blank passes through said plurality of roll forming stations such that at least a portion of said blank is tapered.

2. A method of roll forming tapered structural members as claimed in claim 1 wherein said controlling step comprises the substeps of:

sensing the position of said position adjustable forming rolls of said plurality of roll forming stations;

receiving control information related to the desired position of said position adjustable forming rolls of said plurality of roll forming stations; and, controlling the position of said position adjustable forming rolls of said plurality of roll forming stations in accordance with said sensed position information and said received control information.

3. A method of roll forming tapered structural members as claimed in claim 2, wherein each of said plurality of roll forming stations includes a first assembly of forming rolls and a second assembly of forming rolls, at least one forming roll of said first assembly of forming rolls and at least one forming roll of said second assembly of forming rolls being position adjustable.

4. A method of roll forming tapered structural members as claimed in claim 3, wherein said first assembly of forming rolls is mounted on a first shaft and said second assembly of forming rolls is mounted on a second shaft, and including the step of position adjusting one of said first and second shafts with respect to the other of said shafts whereby the related assembly of forming rolls is position adjustable with respect to the other assembly of forming rolls.

5. A method of roll forming tapered structural members as claimed in claim 4, wherein said first and second assemblies of forming rolls each includes a pair of outer forming rolls and an inner forming roll, and including the steps of: (a) transversely position adjusting the position of the inner forming roll of one of said assemblies of forming rolls; and, (b) position adjusting the outer forming rolls of the other assembly of forming rolls.

6. A method of roll forming tapered structural members as claimed in claim 5, including the step of axially position adjusting the outer forming rolls of said first and second assemblies of forming rolls.

7. A method of roll forming tapered structural members as claimed in claim 6, including the step of rotating said upper and lower shafts.

8. A method or roll forming tapered structural members as claimed in claim 1 wherein said controlling step comprises the substeps of:

detecting the rate of movement of said blank passing through said plurality of roll forming stations;

sensing the position of said position adjustable forming rolls of said plurality of roll forming stations;

receiving control information related to the desired position of said position adjustable forming rolls of said plurality of roll forming stations; and, controlling the position of said position adjustable forming rolls of said plurality of roll forming stations in accordance with said detected rate information, said sensed position information and said received control information.

9. A method of roll forming tapered structural members as claimed in claim 8, wherein each of said plurality of roll forming stations includes a first assembly of forming rolls and a second assembly of forming rolls, at least one forming roll of said first assembly of forming rolls and at least one forming roll of said second assembly of forming rolls being position adjustable.

10. A method of roll forming tapered structural members as claimed in claim 9, wherein said first assembly of forming rolls is mounted on a first shaft and said second assembly of forming rolls is mounted on a second shaft, and including the step of position adjusting one of said first and second shafts with respect to the other of said shafts whereby the related assembly of forming rolls is position adjustable with respect to the other assembly of forming rolls.

11. A method of roll forming tapered structural members as claimed in claim 10, wherein said first and second assemblies of forming rolls each includes a pair of outer forming rolls and an inner forming roll, and including the steps of: (a) transversely position adjusting the position of the inner forming roll of one of said assemblies of forming rolls; and, (b) position adjusting the outer forming rolls of the other assembly of forming rolls.

12. A method of roll forming tapered structural members as claimed in claim 11, including the step of axially position adjusting the outer forming rolls of said first and second assemblies of forming rolls.

13. A method of roll forming tapered structural members as claimed in claim 12, including the step of rotating said upper and lower shafts.

14. Numerically controlled apparatus for roll forming tapered structural members comprising:

a plurality of forming stations positioned so as to sequentially roll form a blank passing therethrough, each of said forming stations including an assembly of forming rolls, at least one of said forming rolls of each of said assemblies of forming rolls being individually and differently position adjustable with respect to the position of the position adjustable forming rolls of the other of said plurality of roll forming stations; and, control means for receiving numerical control signals connected to said plurality of forming stations for selectively controlling the position adjustable rolls of said assemblies of forming rolls in accordance with said numerical control signals such that the position adjustable forming rolls of said assemblies of forming rolls are separately, independently adjusted in an individual and different manner.

15. Numerically controlled apparatus for roll forming tapered structural members as claimed in claim 14 wherein said control means varies the position of said position adjustable forming rolls of said assemblies of forming rolls as said blank passes through said plurality of forming roll stations between zero position adjustment and continuous position adjustment.

16. Numerically controlled apparatus for roll forming tapered structural members as claimed in claim 15, wherein said control means includes sensors for sensing the positions of said position adjustable forming rolls of said assemblies of forming rolls and creating feedback signals in accordance therewith, said feedback signals being compared with said numerical control signals and the results of said comparisons forming position error signals adapted to control the position of said position adjustable forming rolls of said assemblies of forming rolls.

17. Numerically controlled apparatus for roll forming tapered structural members as claimed in claim 16 wherein each of said plurality of forming stations includes first and second shafts and wherein said assemblies of forming rolls include first and second assemblies of forming rolls, said first assembly of forming rolls being mounted on said first shaft and said second assembly of forming rolls being mounted on said second shaft.

18. Numerically controlled apparatus for roll forming tapered structural members as claimed in claim 17, wherein said first shaft is position adjustable with respect to said second shaft.

19. Numerically controlled apparatus for roll forming tapered structural shapes as claimed in claim 18, wherein each of said first and second assemblies of forming rolls includes a pair of outer forming rolls and an inner forming roll.

20. Numerically controlled apparatus for roll forming tapered structural shapes as claimed in claim 19 wherein the inner forming roll of said first assembly of forming rolls is transversely position adjustable with respect to said first shaft.

21. Numerically controlled apparatus for roll forming tapered structural shapes as claimed in claim 20, wherein said outer forming rolls of said second assembly of forming rolls are transversely position adjustable with respect to said second shaft.

22. Numerically controlled apparatus for roll forming tapered structural shapes as claimed in claim 20, wherein the outer forming rolls of said first and second assemblies of forming rolls are axially position adjustable with respect to said first and second shafts.

23. Numerically controlled apparatus for roll forming tapered structural members as claimed in claim 14 wherein said control means senses the rate of movement of a blank through said forming rolls and varies the position of said position adjustable forming rolls of said assemblies of forming rolls as said blank passes through said plurality of forming roll stations between zero position adjustment and continuous position adjustment at a rate related to said sensed rate of movement.

24. Numerically controlled apparatus for roll forming tapered structural members as claimed in claim 23, wherein said control means includes sensors for sensing the position of said position adjustable forming rolls of said assemblies of forming rolls and creating feedback signals in accordance therewith, said feedback signals being compared with said numerical control signals and the results of said comparisons forming position error signals adapted to control the position of said position adjustable forming rolls of said assemblies of forming rolls.

25. Numerically controlled apparatus for roll forming tapered structural members as claimed in claim 24 wherein each of said plurality of forming stations includes first and second shafts and wherein said assemblies of forming rolls include first and second assemblies of forming rolls, said first assembly of forming rolls being mounted on said first shaft and said second assembly of forming rolls being mounted on said second shaft.

26. Numerically controlled apparatus for roll forming tapered structural members as claimed in claim 25, wherein said first shaft is position adjustable with respect to said second shaft.

27. Numerically controlled apparatus for roll forming tapered structural shapes as claimed in claim 26, wherein each of said first and second assemblies of forming rolls includes a pair of outer forming rolls and an inner forming roll.

28. Numerically controlled apparatus for roll forming tapered structural shapes as claimed in claim 27 wherein the inner forming roll of said first assembly of forming rolls is transversely position adjustable with respect to said first shaft.

29. Numerically controlled apparatus for roll forming tapered structural shapes as claimed in claim 28, wherein said outer forming rolls of said second assembly of forming rolls are transversely position adjustable with respect to said second shaft.

30. Numerically controlled apparatus for roll forming tapered structural shapes as claimed in claim 28, wherein the outer forming rolls of said first and second assemblies of forming rolls are axially position adjustable with respect to said first and second shafts.

31. A roll forming station suitable for numerical control comprising:

a first shaft;

a second shaft mounted parallel to said first shaft;

a first assembly of forming rolls mounted on said first shaft;

a second assembly of forming rolls mounted on said second shaft;

a first position control means for varying the position of at least one of the forming rolls of said first and second assemblies of forming rolls between a zero position change and continuous position changes as a blank to be roll formed passes through said roll forming station; and, a first position sensing means for sensing the position of the forming roll whose position is varied by said first control means.

32. A roll forming station suitable for numerical control as claimed in claim 31, including:

a second position control means for controlling the position of said first shaft with respect to said second shaft; and, second position sensing means for sensing the position of said first shaft with respect to said second shaft.

33. A roll forming station suitable for numerical control as claimed in claim 32, wherein:

said first assembly of forming rolls comprises a pair of outer forming rolls and an inner forming roll, said inner forming roll being position adjustable transversely with respect to said first shaft;

said first position control means adjusts the position of said inner forming roll; and said first position sensing means senses the adjusted position of said first forming roll.

34. A roll forming station suitable for numerical control as claimed in claim 33 wherein said second assembly of forming rolls comprises a pair of outer forming rolls and an inner forming roll, said outer forming rolls being transversely position adjustable with respect to said second shaft; and, including (a) a third position adjusting means for adjusting the position of said outer forming rolls of said second assembly of forming rolls; and, (b) a third position sensing means for sensing the position of said outer forming rolls of said second assembly of forming rolls.

35. A roll forming station suitable for numerical control as claimed in claim 34, wherein the outer forming rolls of said first or second set of forming rolls are axially position adjustable with respect to their associated shaft; and, including: (a) a fourth position control means for controlling the axial position of outer forming rolls of said first or second assembly of forming rolls; and, (b) a fourth position sensing means for sensing the axial position of said outer forming rolls of said first and second assemblies of forming rolls.

36. A method of roll forming tapered structural members as claimed in claim 1 including the further step of applying a driving force to said assemblies of forming rolls of said plurality of roll forming stations such that at least selected ones of said forming rolls are positively driven.

37. A method of roll forming tapered structural members as claimed in claim 36 including the further step of coupling together selected ones of the forming rolls forming each assembly of forming rolls such that all of the forming rolls making up each assembly of forming rolls are positively driven by said driving force.

38. Numerically controlled apparatus for roll forming tapered structural members as claimed in claim 14 including driving means coupled to said assemblies of forming rolls for applying a driving force to at least selected ones of said forming rolls making up said assemblies of forming rolls.

39. Numerically controlled apparatus for roll forming tapered structural members as claimed in claim 38 including coupling means for coupling together selected ones of the forming rolls making up each assembly of forming rolls such that all of said forming rolls of each assembly are driven by said driving means.

40. A roll forming station suitable for numerical control as claimed in claim 31 including a driving means connected to said first shaft for applying a positive driving force to at least some of said forming rolls forming said first assembly of forming rolls.

41. A roll forming station suitable for numerical control as claimed in claim 40 including a first coupling means for coupling together the forming rolls forming said first assembly of forming rolls such that all of the forming rolls forming said first assembly are positively driven by said driving means.

42. A roll forming station suitable for numerical control as claimed in claim 41 wherein said driving means is also connected to said second shaft; and including a second coupling means for coupling together the forming rolls forming said second assembly of forming rolls such that all of the forming rolls forming second assembly of forming rolls are positively driven by said driving means.

* * * * *